US009404059B2

(12) United States Patent
Tsujimoto et al.

(10) Patent No.: US 9,404,059 B2
(45) Date of Patent: Aug. 2, 2016

(54) LUBRICATING OIL COMPOSITION FOR MACHINING TOOL

(71) Applicant: JX NIPPON OIL & ENERGY CORPORATION, Tokyo (JP)

(72) Inventors: Teppei Tsujimoto, Tokyo (JP); Tsunetoshi Sugawara, Tokyo (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 0 days.

(21) Appl. No.: 14/386,454

(22) PCT Filed: Oct. 29, 2012

(86) PCT No.: PCT/JP2012/077886
§ 371 (c)(1),
(2) Date: Sep. 19, 2014

(87) PCT Pub. No.: WO2013/140652
PCT Pub. Date: Sep. 26, 2013

(65) Prior Publication Data

US 2015/0072908 A1 Mar. 12, 2015

(30) Foreign Application Priority Data

Mar. 21, 2012 (JP) ..... 2012-063981

(51) Int. Cl.
*C10M 141/10* (2006.01)

(52) U.S. Cl.
CPC ..... *C10M 141/10* (2013.01); *C10M 2203/1025* (2013.01); *C10M 2219/024* (2013.01); *C10M 2219/082* (2013.01); *C10M 2219/106* (2013.01); *C10M 2223/04* (2013.01); *C10M 2223/041* (2013.01); *C10N 2220/022* (2013.01); *C10N 2230/06* (2013.01); *C10N 2240/08* (2013.01)

(58) Field of Classification Search
CPC ..... C10M 141/10; C10M 2203/1025; C10M 2219/024; C10M 2219/082; C10M 2219/106; C10M 2223/04; C10M 2223/041; C10N 2230/06; C10N 2240/08
See application file for complete search history.

(56) References Cited

U.S. PATENT DOCUMENTS

| | | | | |
|---|---|---|---|---|
| 2,274,291 | A * | 2/1942 | Clayton et al. | 508/421 |
| 6,797,679 | B2 | 9/2004 | Kawasaki et al. | |
| 2003/0158050 | A1 | 8/2003 | Kawasaki et al. | |

FOREIGN PATENT DOCUMENTS

| | | | |
|---|---|---|---|
| CN | 101517054 | | 8/2009 |
| JP | 04-015296 | | 1/1992 |
| JP | 7-18285 | | 1/1995 |
| JP | 07-157787 | | 6/1995 |
| JP | 08-134488 | | 5/1996 |
| JP | 08-209175 | | 8/1996 |
| JP | 9-111278 | | 4/1997 |
| JP | 10-053783 | | 2/1998 |
| JP | 11-001693 | | 1/1999 |
| JP | 11-209775 | | 8/1999 |
| JP | 2002-275489 | | 9/2002 |
| JP | 2003-171684 | | 6/2003 |
| JP | 2005-187646 | | 7/2005 |
| JP | 2007-238764 | | 9/2007 |
| JP | 2007-238765 | | 9/2007 |
| JP | 2008-013688 | | 1/2008 |
| JP | 2011-068801 | | 4/2011 |
| JP | 4856451 | | 1/2012 |
| TW | 201005082 | A | 2/2010 |
| WO | 2008/038571 | | 4/2008 |
| WO | 2011/036919 | | 3/2011 |

OTHER PUBLICATIONS

English translation of the International Preliminary Report on Patentability of PCT/JP2012/077886, which was mailed on Oct. 2, 2014.
International Search Report of PCT/JP2012/077886 mailed on Jan. 29, 2013; with an English Translation thereof.
Notification of Information Provision issued with respect to JP Patent Application No. 2012-063981 mailed Oct. 7, 2014.
Notification of Information Provision for JP Application No. 2012-063981, which was mailed on Jan. 6, 2015.
Hajime, Nakao, Performance Requirements for Lubricants and Recent Trends in Additives (Machine Tool Oil),: ENEOS Technical Review, vol. 48, No. 2, Jun. 2006, pp. 38-43; along with a partial translation.
Kazufumi Maeda, "Selecting Suitable Oils for Lubricants for Machine Tools and Administration Thereof," Journal of Economic Maintenance Trilogy, No. 441, 2002, p. 8-12; along with a partial translation thereof.
Chinese Office Action for Application No. 201280071617.1, mailed May 6, 2015.
Taiwanese Office Action issued with respect to application No. 101146239, mail date is Apr. 20, 2016.

* cited by examiner

*Primary Examiner* — Cephia D Toomer
(74) *Attorney, Agent, or Firm* — Greenblum & Bernstein, P.L.C.

(57) ABSTRACT

A lubricant composition for a machining tool, containing: a lubricating base oil; and based on a total amount of the composition, 0.05 to 5% by mass of a phosphoric acid ester represented by $(R^1O)_3P{=}O$: wherein $R^1$ represents any of an aryl group having 6 to 15 carbon atoms and a saturated hydrocarbon group having 1 to 20 carbon atoms, and each $R^1$ may be the same or different; 0.01 to 2% by mass of an acidic phosphoric acid ester represented by $(R^2O)_nP({=}O)(OH)_{(3-n)}$: wherein $R^2$ represents an alkyl group having 4 to 20 carbon atoms, n represents 1 or 2, and $R^2$ may be the same or different; and 0.5% by mass to 5% by mass of a sulfur compound.

5 Claims, No Drawings

LUBRICATING OIL COMPOSITION FOR MACHINING TOOL

TECHNICAL FIELD

The present invention relates to a lubricant composition for a machining tool, and specifically relates to a lubricant composition that is suitably used in lubricating of a slideway surface of a machining tool and used as an oil for use in a hydraulic apparatus.

BACKGROUND ART

Lubricants for slideway surfaces such as work tables of machining tools are required to have lubricity in order to improve working accuracy. Then, in order to meet such a requirement, a lubricant to which additives such as an extreme pressure agent and an oiliness agent are blended is used. In addition, such lubricants are also required to have lubricity to a hydraulic pump as accessory equipment of a machining tool in terms of a proper operation of a machining tool, and a lubricant to which additives such as an extreme pressure agent and an oiliness agent are blended is used.

Examples of such additives include phosphoric acid esters, acidic phosphoric, acid esters, phosphorous acid esters, carboxylic acids, a sulfur compound and amines (see, for example, Patent Literature 1). In addition, there has been attempted to neutralize an acidic phosphoric acid ester by an alkyl amine to thereby result in the improvement in stability (see, for example, Patent Literature 2).

In addition, oiliness agents include amines such as monoamines, polyamines and alkanolamines (see, for example, Patent Literatures 2 and 3). Monoamines and polyamines are blended as a simple substance thereof (see, for example, Patent Literature 2). In addition, with respect to alkanolamines, a method in which they are used as a compound for forming a salt such as an amine salt with an acidic phosphoric acid ester or an amide with a carboxylic acid is described (see, for example, Patent Literature 3).

CITATION LIST

Patent Literature

[Patent Literature 1] Japanese Patent Application Laid-Open No. 8-134488

[Patent Literature 2] Japanese Patent Application Laid-Open No. 2007-238764

[Patent Literature 3] Japanese Patent Application Laid-Open No. 2008-013688

SUMMARY OF INVENTION

Technical Problem

In recent years, however, a further improvement in lubricity has been required. Then, a conventional lubricant to which the above additives are blended is difficult to meet such a requirement, and in particular antiwear performance tends to be insufficient.

The present invention has been made in view of such circumstances, and an object thereof is to provide a lubricant composition for a machining tool, having an excellent antiwear performance.

Solution to Problem

The present inventors have made intensive studies in order to achieve the above object, and as a result, have found that the above problem is solved by a lubricant composition containing a lubricating base oil, and a specific phosphoric acid ester compound, a specific acidic phosphoric acid ester and a sulfur compound in respective specific amounts, leading to the completion of the present invention.

That is, the lubricant composition for a machining tool of the present invention contains:

lubricant base oil; and, based on a total amount of the composition, 0.05 to 5% by mass of a phosphoric acid ester represented by the following general formula (1):

$$(R^1O)_3P{=}O \quad (1)$$

wherein $R^1$ represents any of an aryl group having 6 to 15 carbon atoms and a saturated hydrocarbon group having 1 to 20 carbon atoms, and each $R^1$ may be the same or different;

0.01 to 2% by mass of an acidic phosphoric acid ester represented by the following general formula (2):

$$(R^2O)_nP({=}O)(OH)_{(3-n)} \quad (2)$$

wherein $R^2$ represents an alkyl group having 4 to 20 carbon atoms, n represents 1 or 2, and $R^2$ may be the same or different; and 0.5 to 5% by mass of a sulfur compound.

$R^2$ in the above general formula (2) preferably represents an alkyl group having 8 carbon atoms.

In addition, $R^1$ in the above general formula (1) preferably represents a saturated hydrocarbon group having 1 to 20 carbon atoms.

The lubricant composition for a machining tool of the present invention may be suitably used as a lubricant for simultaneously lubricating a slideway surface and a hydraulic pump of a machining tool.

Advantageous Effects of Invention

The lubricant composition of the present invention is excellent in antiwear performance. Accordingly, the lubricating oil composition of the present invention is very useful in terms of stabilization of an operation of a machining tool and high machining accuracy. Also in lubricating of a hydraulic pump, the lubricating oil composition of the present invention is very useful in terms of antiwear performance.

DESCRIPTION OF EMBODIMENTS

Hereinafter, a suitable embodiment of the present invention will be described in detail.

A lubricating oil composition for a machining tool according to an embodiment of the present invention contains:

lubricant base oil; and (A) a phosphoric acid ester represented by the following general formula (1) (hereinafter, also referred to as "component (A)".):

$$(R^1O)_3P{=}O \quad (1)$$

wherein $R^1$ represents any of an aryl group having 6 to 15 carbon atoms and a saturated hydrocarbon group having 1 to 20 carbon atoms, and each $R^1$ may be the same or different;

(B) an acidic phosphoric acid ester represented by the following general formula (2) (hereinafter, also referred to as "component (B)".):

$$(R^2O)_nP({=}O)(OH)_{(3-n)} \quad (2)$$

wherein $R^2$ represents an alkyl group having 4 to 20 carbon atoms, n represents 1 or 2, and each $R^2$ may be the same or different; and (C) a sulfur compound (hereinafter, also referred to as "component (C)".). The contents of the component (A) to the component (C) are, based on the total amount of the composition, 0.05 to 5% by mass, 0.01 to 2% by mass, and 0.5 to 5% by mass, respectively.

The lubricant base oil in the present embodiment is not particularly restricted, but examples thereof include a mineral oil, oil and fat, and a synthetic oil.

The mineral oil is not particularly restricted in terms of the production method thereof, and examples thereof include a paraffinic or naphthenic mineral oil that is obtainable by applying, to a lubricant fraction obtainable by distilling a crude oil at ordinary pressure or under reduced pressure, one or a combination of two or more of refining measures such as solvent deasphalting, solvent extraction, hydrocracking, solvent dewaxing, catalytic dewaxing, hydrorefining, sulfuric acid washing and a clay treatment.

Examples of the oil and fat include beef tallow, lard, a soybean oil, a rapeseed oil, a rice bran oil, a coconut oil, a palm oil, a palm kernel oil, or a hydrogenated product thereof. In addition, the oil and fat in which the content of an oleic acid is increased by means of a recombinant DNA technology may also be suitably used.

Examples of the synthetic oil include poly-α-olefins (an ethylene-propylene copolymer, polybutene, a 1-octene oligomer, a 1-decene oligomer, hydrides thereof, and the like), alkylbenzenes, alkylnaphthalenes, monoesters (butyl stearate, octyl laurate and the like), diesters (ditridecyl glutarate, di-2-ethylhexyl adipate, diisodecyl adipate, ditridecyl adipate, di-2-ethylhexyl sebacate and the like), polyesters (trimellitic acid esters and the like), polyol esters (trimethylolpropane caprylate, trimethylolpropane pelargonate, pentaerythritol-2-ethylhexanoate, pentaerythritol pelargonate and the like), polyoxyalkylene glycols, polyphenyl ethers, dialkyl diphenyl ethers, phosphoric acid esters (tricresyl phosphate and the like), a fluorine-containing compound (perfluoropolyethers, fluorinated polyolefins and the like) and a silicone oil.

In the present embodiment, as the lubricant base oil, one selected from the above mineral oils, oils and fats and synthetic oils may be used singly, or two or more selected therefrom may be used in combination.

The viscosity of the lubricant base oil is not particularly restricted, but the kinematic viscosity at 40° C. thereof is preferably 10 to 700 $mm^2/s$ and more preferably 15 to 500 $mm^2/s$.

In addition, the content of the lubricant base oil is not particularly limited, but is preferably 50 to 99.98% by mass based on the total amount of the composition.

The phosphoric acid ester of the component (A) is a compound represented by the above general formula (1), and is an orthophosphoric acid ester having a group selected from an aryl group having 6 to 15 carbon atoms (preferably an aryl group having 6 to 9 carbon atoms) and a saturated hydrocarbon group having 1 to 20 carbon atoms (preferably a saturated hydrocarbon group having 4 to 12 carbon atoms), more preferably a saturated hydrocarbon group having 8 to 12 carbon atoms.

Specific examples of the phosphoric acid ester of the component (A) include triphenyl phosphate, tricresyl phosphate, trixylenyl phosphate, cresyl diphenyl phosphate, xylenyl diphenyl phosphate, tris(isopropylphenyl)phosphate, tris(t-butylphenyl)phosphate, tributyl phosphate (including linear or branched ones), tripentyl phosphate (including linear or branched ones), trihexyl phosphate (including linear or branched ones), triheptyl phosphate (including linear or branched ones), trioctyl phosphate (including linear or branched ones), trinonyl phosphate (including linear or branched ones), tridecyl phosphate (including linear or branched ones), triundecyl phosphate (including linear or branched ones), tridodecyl phosphate (including linear or branched ones), tritridecyl phosphate (including linear or branched ones), tritetradecyl phosphate (including linear or branched ones), tripentadecyl phosphate (including linear or branched ones), trihexadecyl phosphate (including linear or branched ones), triheptadecyl phosphate (including linear or branched ones), trioctadecyl phosphate (including linear or branched ones) and trioleyl phosphate (including linear or branched ones).

Among them, triphenyl phosphate, tricresyl phosphate, triheptyl phosphate (including linear or branched ones), trioctyl phosphate (including linear or branched ones), trinonyl phosphate (including linear or branched ones) and tridecyl phosphate (including linear or branched ones) are preferable;

tricresyl phosphate and trioctyl phosphate (including linear or branched ones) are more preferable;

trioctyl phosphate (including linear or branched ones) is further preferable; and tri(2-ethylhexyl)phosphate is particularly preferable.

The content of the phosphoric acid ester of the component (A) is 0.05% by mass or more, preferably 0.1% by mass or more and more preferably 0.2% by mass or more, and 5% by mass or less and preferably 3% by mass or less, based on the total amount of the composition. If the content is less than 0.05% by mass, antiwear performance is insufficient. In addition, if the content is more than 5% by mass, the antiwear performance improvement effect corresponding to the content is not achieved, and such a case is not preferable in terms of economic efficiency.

The acidic phosphoric acid ester of the component (B) is a compound represented by the above general formula (2), and is an acidic phosphoric acid ester having an alkyl group having 4 to 20 carbon atoms.

Specific examples of the acidic phosphoric acid ester of the component (B) include monoalkyl acidic phosphoric acid esters, dialkyl acidic phosphoric acid esters, and mixtures thereof. The alkyl group of these alkyl acidic phosphoric acid esters may be a linear or branched alkyl group and may be saturated or unsaturated, but is preferably linear. The number of carbon atoms in the alkyl group is 4 to 20, preferably 6 to 16 and more preferably 6 to 10, and a linear alkyl group having 8 carbon atoms (n-octyl group) is most preferable. In addition, the numbers of carbon atoms in the two alkyl groups of the dialkyl acidic phosphoric acid esters may be the same or different.

If the number of carbon atoms is 4 or less, such a case is not preferable because solubility is poor. In addition, if the number of carbon atoms is more than 20, the effect per unit mass is impaired and such a case is not preferable.

Specific examples of the alkyl group having 4 to 20 carbon atoms include a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group and a nonadecyl group, and it is possible for each of them to use saturated or unsaturated linear, or saturated or unsaturated branched one.

Specific examples of the acidic phosphoric acid ester include mono-n-butyl acid phosphate, mono-n-pentyl acid phosphate, mono-n-hexyl acid phosphate, mono-n-heptyl acid acid phosphate, mono-n-octyl acid phosphate, mono-n-nonyl acid phosphate, mono-n-decyl acid phosphate, mono-n-dodecyl acid phosphate, mono-n-octadecyl acid phosphate, mono-iso-butyl acid phosphate, mono-iso-pentyl acid phosphate, mono-iso-hexyl acid phosphate, mono-iso-heptyl acid acid phosphate, mono-iso-octyl acid phosphate, mono-iso-nonyl acid phosphate, mono-iso-decyl acid phosphate, mono-iso-dodecyl acid phosphate, mono-iso-hexadecyl acid phosphate, mono-iso-octadecyl acid phosphate, di-n-butyl acid phosphate, di-n-pentyl acid phosphate, di-n-hexyl acid phosphate, di-n-heptyl acid acid phosphate, di-n-octyl acid phosphate, di-n-nonyl acid phosphate, di-n-decyl acid phosphate, di-n-dodecyl acid phosphate, di-n-octadecyl acid phosphate, di-iso-butyl acid phosphate, di-iso-pentyl acid phosphate, di-iso-hexyl acid phosphate, di-iso-heptyl acid acid phosphate, di-iso-octyl acid phosphate, di-iso-nonyl acid phosphate, di-iso-decyl acid phosphate, di-iso-dodecyl acid phosphate, di-iso-hexadecyl acid phosphate and di-iso-octadecyl acid phosphate.

Among them, mono-n-hexyl acid phosphate, mono-n-heptyl acid acid phosphate, mono-n-octyl acid phosphate, mono-n-nonyl acid phosphate, mono-n-decyl acid phosphate, di-n-hexyl acid phosphate, di-n-heptyl acid acid phosphate, di-n-octyl acid phosphate, di-n-nonyl acid phosphate, di-n-decyl acid phosphate, di-n-hexyl acid phosphate, di-n-heptyl acid acid phosphate, di-n-octyl acid phosphate, di-n-nonyl acid phosphate, di-n-decyl acid phosphate, di-iso-hexyl acid phosphate, di-iso-heptyl acid acid phosphate, di-iso-octyl acid phosphate, di-iso-nonyl acid phosphate and di-iso-decyl acid phosphate are preferable; and mono-n-octyl acid phosphate, di-n-octyl acid phosphate, di-iso-octyl acid phosphate, and mixtures thereof are more preferable.

In the lubricant composition according to the present embodiment, the content of the acidic phosphoric acid ester of the component (B) is 0.01% by mass or more, more preferably 0.02% by mass or more and more preferably 0.3% by mass or more, and 2% by mass or less, more preferably 1% by mass or less and most preferably 0.8% by mass or less, based on the total amount of the composition. If the content is less than 0.01% by mass, antiwear performance is insufficient. In addition, if the content is more than 2% by mass, the antiwear performance improvement effect corresponding to the content is not achieved, and such a case is not preferable in terms of economic efficiency.

The sulfur compound of the component (C) is not particularly restricted as long as characteristics of the lubricant composition are not impaired, but sulfurized oil and fat, a thiadiazole compound, dihydrocarbyl polysulfide, sulfurized fatty acids, sulfurized olefins, sulfide esters, a sulfurized mineral oil, a zinc dithiophosphate compound, a zinc dithiocarbamate compound, a molybdenum dithiophosphate compound, a molybdenum dithiocarbamate compound, an alkylthiocarbamoyl compound, a thiocarbamate compound, a thioterpene compound and a dialkylthiopropionate compound are preferably used.

The sulfurized oil and fat is one obtainable by reacting sulfur or a sulfur-containing compound with oil and fat (lard oil, whale oil, vegetable oil, fish oil and the like), and examples thereof include sulfurized lard, a sulfurized rapeseed oil, a sulfurized castor oil, a sulfurized soybean oil and a sulfurized rice bran oil.

Examples of the thiadiazole compound include 1,3,4-thiadiazole represented by the following general formula (3), a 1,2,4-thiadiazole compound represented by the following general formula (4) and a 1,4,5-thiadiazole compound represented by the following general formula (5):

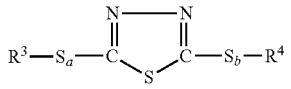

(3)

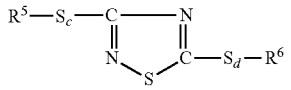

(4)

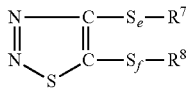

(5)

wherein $R^3$, $R^4$, $R^5$, $R^6$, $R^7$ and $R^8$ may be the same or different and each represent a hydrogen atom or a hydrocarbon group having 1 to 20 carbon atoms, and a, b, c, d, e and f may be the same or different and each represent an integer of 0 to 8.

Specific examples of such a thiadiazole compound preferably include 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole, 2,5-bis(1,1,3,3-tetramethylbutyldithio)-1,3,4-thiadiazole, 3,5-bis(n-hexyldithio)-1,2,4-thiadiazole, 3,5-bis(n-octyldithio)-1,2,4-thiadiazole, 3,5-bis(n-nonyldithio)-1,2,4-thiadiazole, 3,5-bis(1,1,3,3-tetramethylbutyldithio)-1,2,4-thiadiazole, 4,5-bis(n-hexyldithio)-1,2,3-thiadiazole, 4,5-bis(n-octyldithio)-1,2,3-thiadiazole, 4,5-bis(n-nonyldithio)-1,2,3-thiadiazole, 4,5-bis(1,1,3,3-tetramethylbutyldithio)-1,2,3-thiadiazole, and mixtures thereof.

Dihydrocarbyl polysulfide is generally a sulfur-based compound called polysulfide or sulfurized olefin, and specifically means a compound represented by the following general formula (6):

$$R^9—S_x—R^{10} \quad (6)$$

wherein $R^9$ and $R^{10}$ may be the same or different and each represent a linear or branched alkyl group having 3 to 20 carbon atoms, an aryl group having 6 to 20 carbon atoms, an alkylaryl group having 6 to 20 carbon atoms or an arylalkyl group having 6 to 20 carbon atoms, and x represents an integer of 2 to 6, preferably an integer of 2 to 5.

$R^9$ and $R^{10}$ in the above general formula (6) specifically include respective linear or branched alkyl groups of a propyl group, a butyl group, a pentyl group, a hexyl group, a heptyl group, an octyl group, a nonyl group, a decyl group, an undecyl group, a dodecyl group; a tridecyl group, a tetradecyl group, a pentadecyl group, a hexadecyl group, a heptadecyl group, an octadecyl group, a nonadecyl group and an icosyl group;

aryl groups such as phenyl group and a naphthyl group; and alkylaryl groups such as a tolyl group, an ethylphenyl group, a xylyl group, an ethylmethylphenyl group, a diethylphenyl group, a linear or branched propylphenyl group, a linear or branched butylphenyl group, a linear or branched pentylphenyl group, a linear or branched hexylphenyl group, a linear or branched heptylphenyl group, a linear or branched octylphenyl group, a linear or branched nonylphenyl group, a linear or branched decylphenyl group, a linear or branched undecylphenyl group, a linear or branched dodecylphenyl group, a di(linear or branched)propylphenyl group, a di(linear or branched)butylphenyl group, a methylnaphthyl group, an ethylnaphthyl group, a linear or branched propylnaphthyl group, a linear or branched butylnaphthyl group, a dimethylnaphthyl group, an ethylmethylnaphthyl group, a diethylnaphthyl group, a di(linear or branched)propylnaphthyl group and a di(linear or branched)butylnaphthyl group; and arylalkyl groups such as a benzyl group, a phenylethyl group and a phenylpropyl group; and all compounds include all isomers and structural isomers.

Among them, as $R^9$ and $R^{10}$ in the general formula (6), an alkyl group having 3 to 18 carbon atoms, derived from propylene, 1-butene or isobutylene, or an aryl group, an alkylaryl group or an arylalkyl group having 6 to 8 carbon atoms is preferable, and in particular, an alkyl group having 3 to 18 carbon atoms, derived from propylene, 1-butene or isobutylene is preferable. Examples of these groups include alkyl groups such as an isopropyl group, a branched hexyl group derived from a propylene dimer, a branched nonyl group derived from a propylene trimer, a branched dodecyl group derived from a propylene tetramer, a branched pentadecyl group derived from a propylene pentamer, a branched octadecyl group derived from a propylene hexamer, a sec-butyl group, a tert-butyl group, a branched octyl group derived from a 1-butene dimer, a branched octyl group derived from an isobutylene dimer, a branched dodecyl group derived from a 1-butene trimer, a branched dodecyl group derived from an isobutylene trimer, a branched hexadecyl group derived from a 1-butene tetramer and a branched hexadecyl group derived from an isobutylene tetramer, and all groups include all branched isomers.

Furthermore, as $R^9$ and $R^{10}$ in the above general formula (6), separately, a branched alkyl group having 3 to 18 carbon atoms, derived from ethylene or propylene, is more preferable and a branched alkyl group having 6 to 15 carbon atoms, derived from ethylene or propylene, is particularly preferable from the viewpoint of the improvement in antiwear performance.

Examples of the sulfurized fatty acid include oleic acid sulfide.

Examples of the sulfurized olefin include a compound represented by the following general formula (7). This compound is obtainable by reacting olefins having 2 to 15 carbon atoms or di- to tetramers thereof with a sulfurizing agent such as sulfur or sulfur chloride, and as the olefins, propylene, isobutene, diisobutene and the like are preferable:

$$R^{11}—S_y—R^{12} \quad (7)$$

wherein $R^{11}$ represents an alkenyl group having 2 to 15 carbon atoms, $R^{12}$ represents an alkyl group or an alkenyl group having 2 to 15 carbon atoms, and y represents an integer of 1 to 8.

Examples of the sulfide ester include animal and vegetable oils and fats such as beef tallow, lard, fish fat, a rapeseed oil and a soybean oil; unsaturated fatty acid esters obtainable by reacting unsaturated fatty acids (including oleic acid, linoleic acid or fatty acids extracted from the above animal and vegetable oils and fats) with various alcohols; and those obtainable by sulfurizing mixtures thereof by an arbitrary method. More specific examples include methyl oleate sulfide, rice bean fatty acid octyl sulfide, and mixtures thereof.

The sulfurized mineral oil refers to one in which elemental sulfur is dissolved in a mineral oil. Herein, the mineral oil for use in the sulfurized mineral oil in the present invention is not particularly restricted, but any of those listed as the mineral oil of the base oil in the invention of the present application may be used therefor. In addition, as elemental sulfur, one in the form of any of a mass, a powder, a molten liquid and the like may also be used, but elemental sulfur in the form of a powder or a molten liquid may be preferably used because of capable of being effectively dissolved in the base oil. The content of sulfur in the sulfurized mineral oil is not particularly restricted, but is usually preferably 0.05 to 1.0% by mass and more preferably 0.1 to 0.5% by mass based on the total amount of the sulfurized mineral oil.

The zinc dithiophosphate compound, the zinc dithiocarbamate compound, the molybdenum dithiophosphate compound and the molybdenum dithiocarbamate compound mean compounds represented by the following general formulae (8) to (11), respectively:

(8)

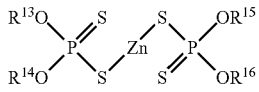

(9)

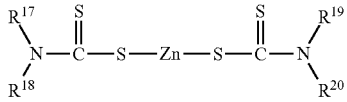

(10)

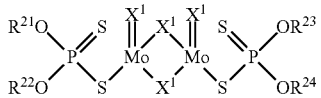

(11)

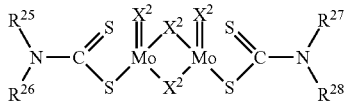

wherein $R^{13}$, $R^{14}$, $R^{15}$, $R^{16}$, $R^{17}$, $R^{18}$, $R^{19}$, $R^{20}$, $R^{21}$, $R^{22}$, $R^{23}$, $R^{24}$, $R^{25}$, $R^{26}$, $R^{27}$ and $R^{28}$ may be the same or different and each represent a hydrocarbon group having one or more carbon atoms, and $X^1$ and $X^2$ each represent an oxygen atom or a sulfur atom.

Herein, specific examples of the hydrocarbon groups represented by $R^{13}$, $R^{14}$, $R^{15}$, $R^{16}$, $R^{17}$, $R^{18}$, $R^{19}$, $R^{20}$, $R^{21}$, $R^{22}$, $R^{23}$, $R^{24}$, $R^{25}$, $R^{26}$, $R^{27}$ and $R^{28}$ include, in addition to a methyl group and an ethyl group, alkyl groups such as a propyl group, a butyl group, a pentyl group, a hexyl group (including all branched isomers), a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an icosyl group, a heneicosyl group, a docosyl group, a tricosyl group and a tetracosyl group, all groups including all branched isomers;

cycloalkyl groups such as a cyclopentyl group, a cyclohexyl group and a cycloheptyl group;

alkylcycloalkyl groups such as a methylcyclopentyl group, an ethylcyclopentyl group, a dimethylcyclopentyl group, a propylcyclopentyl group, a methylethylcyclopentyl group, a trimethylcyclopentyl group, a butylcyclopentyl group, a methylpropylcyclopentyl group, a diethylcyclopentyl group, a dimethylethylcyclopentyl group, a methylcyclohexyl group, an ethylcyclohexyl group, a din group, a propylcyclohexyl group, a methylethylcyclohexyl group, a trimethylcyclohexyl group, a butylcyclohexyl group, a rnethylpropylcyclohexyl group, a diethyl cyclohexyl group, a dim ethyl ethylcyclohexyl group, a methylcycloheptyl group, an ethylcycloheptyl group, a dimethylcycloheptyl group, a propylcycloheptyl group, a methylethylcycloheptyl group, a trimethylcycloheptyl group, a butylcycloheptyl group, a methylpropylcycloheptyl group, a diethylcycloheptyl group and a dimethylethylcycloheptyl group, all groups including all substituted isomers and branched isomers;

aryl groups such as a phenyl group and a naphthyl group;

alkylaryl groups such as a tolyl group, a xylyl group, an ethylphenyl group, a propylphenyl group, a methylethylphenyl group, a trimethylphenyl group, a butylphenyl group, a methylpropylphenyl group, a diethylphenyl group, a dimethylethylphenyl group, a pentylphenyl group, a hexylphenyl group, a heptylphenyl group, a octylphenyl group, a nonylphenyl group, a decylphenyl group, an undecylphenyl group, a dodecylphenyl group, a tridecylphenyl group, a tetradecylphenyl group, a pentadecylphenyl group, a hexadecylphenyl group, a heptadecylphenyl group and an octadecylphenyl group, all groups including all substituted isomers and branched isomers; and arylalkyl groups such as a benzyl group, a phenethyl group, a phenylpropyl group (including all branched isomers) and a phenylbutyl group (including all branched isomers).

Examples of the alkylcarbamoyl compound include a compound represented by the following general formula (12):

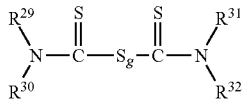

(12)

wherein $R^{29}$, $R^{30}$, $R^{31}$ and $R^{32}$ may be the same or different and each represent an alkyl group having 1 to 20 carbon atoms, and g represents an integer of 1 to 8.

Specific examples of such an alkylcarbamoyl compound preferably include bis(dimethylthiocarbamoyl)monosulfide, bis(dibutylthiocarbamoyl)monosulfide, bis(dimethylthiocarbamoyl)disulfide, bis(dibutylthiocarbamoyl)disulfide, bis(diamylthiocarbamoyl)disulfide, bis(dioctylthiocarbamoyl)disulfide, and mixtures thereof.

Examples of the alkylthiocarbamate compound include a compound represented by the following general formula (13):

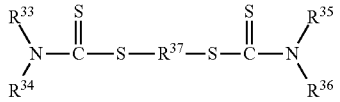

(13)

wherein $R^{33}$, $R^{34}$, $R^{35}$ and $R^{36}$ may be the same or different and each represent an alkyl group having 1 to 20 carbon atoms, and $R^{37}$ represents an alkyl group having 1 to 10 carbon atoms.

Specific examples of such an alkylthiocarbamate compound preferably include methylenebis(dibutyldithiocarbamate) and methylenebis[di(2-ethylhexyl)dithiocarbamate].

Furthermore, examples of the thioterpene compound include a reaction product of phosphorus pentasulfide and pinene, and examples of the dialkylthiopropionate compound include dilauryl thiodipropionate, distearyl thiodipropionate, and mixtures thereof.

In the present embodiment, when at least one selected from the group consisting of the sulfurized oil and fat, the thiadiazole compound and dihydrocarbyl polysulfide among the above sulfur compounds is used, such a case is preferable because the wear-resistant characteristic improvement effect is achieved at a higher level, and it is more preferable to use further the sulfurized oil and fat.

In the lubricant composition according to the present embodiment, when the component (C) is a sulfur compound other than the thiadiazole compound, the content thereof is 0.5% by mass or more and more preferably 0.7% by mass or more, and 5% by mass or less and more preferably 3% by mass or less, based on the total amount of the composition. If the content is less than 0.5% by mass, antiwear performance is insufficient, and if the content is more than 2% by mass, the antiwear performance improvement effect corresponding to the content is not achieved, and such a case is not preferable in terms of economic efficiency.

In addition, when the component (C) is the thiadiazole compound, the content thereof is 0.05% by mass or more and more preferably 0.1% by mass or more, and 1% by mass or less and more preferably 0.5% by mass or less, based on the total amount of the composition. If the content is less than 0.05% by mass, antiwear performance is insufficient, and if the content is more than 1% by mass, the antiwear performance improvement effect corresponding to the content is not achieved, and such a case is not preferable in terms of economic efficiency.

It is possible to blend to the lubricant composition according to the present embodiment an additive known in the lubricant field in order to enhance the performance of the lubricant composition and to impart, to the lubricant composition, performances necessary for the lubricant composition, in particular, a lubricant composition for a sliding surface of a machining tool.

Examples of such an additive include antioxidants such as monohydric alcohols or polyhydric alcohols, monobasic acids or polybasic acids, esters of the alcohols and the acids, phenolic compounds such as di-tert-butyl-p-cresol and bisphenol A, and amine-based compounds such as phenyl-α-naphthylamine and N,N'-di(2-naphthyl)-p-phenylenediamine;

anti-wear agents such as a sulfur-containing phosphoric acid ester compound;

oiliness agents such as esters, carboxylic acids and aliphatic alcohols;

metal deactivators such as benzotriazole;

anti-foaming agents such as a silicone oil and a fluorosilicone oil;

anti-corrosion additives such as alkenylsuccinic acids and sorbitan monooleate;

pour-point depressants such as polymethacrylate;

viscosity index improvers such as polybutene, polyalkylstyrenes, an olefin copolymer, a styrene-diene copolymer and a styrene-maleic anhydride copolymer; and oil film-retaining agents of olefin-based polymers such as an ethylene-propylene copolymer, polybutene and polyisobutylene.

The lubricant composition according to the present embodiment is excellent in antiwear performance. Accordingly, the lubricant composition according to the present embodiment is very useful in terms of stabilization of operation of a machining tool, working accuracy and the like. In addition, the lubricant composition according to the present embodiment is very useful because of being capable of suppressing the increase in liquid leakage due to wear occurring in a hydraulic pump and maintaining pump efficiency. Furthermore, the lubricant composition according to the present embodiment may be suitably used in various applications in which antiwear performance is required. In particular, in the case where the lubricant composition is used as a lubricant for a slideway surface (sliding surface) of a machining tool or the like, the above effect is further exerted. In addition, even in the case where the lubricant composition is used as a hydraulic oil, the above effect is further exerted.

EXAMPLES

Hereinafter, the present invention will be more specifically described based on Examples and Comparative Examples, but the present invention is not limited to these Examples at all.

Examples 1 to 16, Comparative Examples 1 to 7

In Examples 1 to 16 and Comparative Examples 1 to 7, lubricant compositions each having composition shown in Tables 1 to 4 were prepared. Components used in preparation of each of the lubricant compositions are as follows.

Lubricant Base Oil

Base oil 1: solvent-dewaxed and hydrorefined paraffinic mineral oil (kinematic viscosity at 40° C.: 68.8 $mm^2/s$; viscosity index: 98; sulfur content: 0.62% by mass)

Base oil 2: synthetic lubrication base material (number average molecular weight: 3700; kinematic viscosity at 100° C.: 2000 $mm^2/s$; viscosity index: 300; sulfur content: less than 0.1% by mass)

Component (A): Phosphoric Acid Ester

A1: tri(2-ethylhexyl)phosphate

A2: tricresyl phosphate

A3: tri(isopropylaryl)phosphoric acid ester represented by the following general formula (14)

(14)

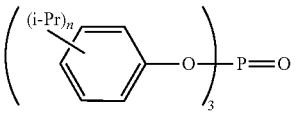

wherein i-Pr represents an isopropyl group and n represents a mixture of 1 to 3.

Component (B): Acidic Phosphoric Acid Ester

B1: n-butyl acid phosphate

B2: n-octyl acid phosphate

B3: 2-ethylhexyl acid phosphate

B4: oleyl acid phosphate

B5: eicosa acid phosphate

B6: docosa acid phosphate (mixture of linear and branched ones)

Component (C): Sulfur Compound

C1: sulfurized oil and fat

C2: 2,5-bis(1,1,3,3-tetramethylbutyldithio)-1,3,4-thiadiazole

C3: di-tert-dodecyl polysulfide

Then, each of the lubricant compositions in Examples 1 to 16 and Comparative Examples 1 to 7 was subjected to the following test.

<Lubricity Test>

The evaluation of lubricity was according to ASTM D3233-93 (Falex P/V test) and the abrasion wear (mg) was measured. The obtained results are shown in Tables 1 to 4. Herein, "Fractured" in Table 4 means breakage such as bending or twisting of P (pin).

TABLE 1

| | | Example 1 | Example 2 | Example 3 | Example 4 | Example 5 |
|---|---|---|---|---|---|---|
| Composition, % by mass | Base oil 1 | Balance | Balance | Balance | Balance | Balance |
| | Base oil 2 | 4 | 4 | 4 | 4 | 4 |
| | A1 | 0.2 | 0.5 | 5 | 0.05 | 0.5 |
| | A2 | — | — | — | — | |
| | A3 | — | — | — | — | — |
| | B1 | — | — | — | — | — |
| | B2 | 0.05 | 0.05 | 0.05 | 1 | 0.01 |
| | B3 | — | — | — | — | — |
| | B4 | — | — | — | — | — |
| | B5 | — | — | — | — | — |
| | B6 | — | — | — | — | — |
| | C1 | 1 | 1 | 1 | 1 | 1 |
| | C2 | — | — | — | — | — |
| | C3 | — | — | — | — | — |
| Abrasion Wear [mg] | | 3.6 | 3.7 | 4.1 | 3.8 | 4.0 |

TABLE 2

| | | Example 6 | Example 7 | Example 8 | Example 9 | Example 10 |
|---|---|---|---|---|---|---|
| Composition, % by mass | Base oil 1 | Balance | Balance | Balance | Balance | Balance |
| | Base oil 2 | 4 | 4 | 4 | 4 | 4 |
| | A1 | 0.5 | 0.5 | 0.5 | 0.5 | 0.5 |
| | A2 | — | — | — | — | — |
| | A3 | — | — | — | — | — |
| | B1 | — | — | — | — | — |
| | B2 | 1 | 0.05 | 0.05 | 0.05 | 0.05 |
| | B3 | — | — | — | — | — |
| | B4 | — | — | — | — | — |
| | B5 | — | — | — | — | — |
| | B6 | — | — | — | — | — |
| | C1 | 1 | 0.5 | 2 | — | — |
| | C2 | — | — | — | 1 | — |
| | C3 | — | — | — | — | 1 |
| Abrasion Wear [mg] | | 4.2 | 3.7 | 4.2 | 4.7 | 9.5 |

TABLE 3

| | | Example 11 | Example 12 | Example 13 | Example 14 | Example 15 | Example 16 |
|---|---|---|---|---|---|---|---|
| Composition, % by mass | Base oil 1 | Balance | Balance | Balance | Balance | Balance | Balance |
| | Base oil 2 | 4 | 4 | 4 | 4 | 4 | 4 |
| | A1 | — | — | 0.5 | 0.5 | 0.5 | 0.5 |
| | A2 | 0.5 | — | — | — | — | — |
| | A3 | — | 0.5 | — | — | — | — |
| | B1 | — | — | 0.05 | — | — | — |
| | B2 | 0.05 | 0.05 | — | — | — | — |
| | B3 | — | — | — | 0.05 | — | — |
| | B4 | — | — | — | — | 0.05 | — |

TABLE 3-continued

| | Example 11 | Example 12 | Example 13 | Example 14 | Example 15 | Example 16 |
|---|---|---|---|---|---|---|
| B5 | — | — | — | — | — | 0.05 |
| B6 | — | — | — | — | — | — |
| C1 | 1 | 1 | 1 | 1 | 1 | 1 |
| C2 | — | — | — | — | — | — |
| C3 | — | — | — | — | — | — |
| Abrasion Wear [mg] | 6.9 | 7.5 | 8.9 | 6.2 | 9.3 | 9.8 |

TABLE 4

| | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|
| Composition, % by mass | Base oil 1 | Balance | Balance | Balance | Balance | Balance | Balance | Balance |
| | Base oil 2 | 4 | 4 | 4 | 4 | 4 | 4 | 4 |
| | A1 | 0.5 | 1.5 | 0.5 | 0.75 | — | — | 0.5 |
| | A2 | — | — | — | — | — | — | — |
| | A3 | — | — | — | — | — | — | — |
| | B1 | — | — | — | — | — | — | — |
| | B2 | 0.05 | 0.05 | — | — | 0.05 | 1 | — |
| | B3 | — | — | — | — | — | — | — |
| | B4 | — | — | — | — | — | — | — |
| | B5 | — | — | — | — | — | — | -0.05 |
| | B6 | — | — | — | — | — | — | — |
| | C1 | — | — | 1 | 1 | 1 | 1 | 1 |
| | C2 | — | — | — | — | — | — | — |
| | C3 | — | — | — | — | — | — | — |
| Abrasion Wear [mg] | | Fractured | Fractured | 13.1 | 12.9 | 14.3 | 13.4 | 10.1 |

The invention claimed is:

1. A lubricant composition for a machining tool, containing:

lubricant base oil; and, based on a total amount of the composition, 0.05 to 5% by mass of a phosphoric acid ester represented by the following general formula (1):

$$(R^1O)_3P{=}o \quad (1)$$

wherein $R^1$ represents any of an aryl group having 6 to 15 carbon atoms and a saturated hydrocarbon group having 1 to 20 carbon atoms, and each $R^1$ may be the same or different;

0.01 to 2% by mass of an acidic phosphoric acid ester represented by the following general formula (2):

$$(R^2O)_nP(=O)(OH)_{(3-n)} \quad (2)$$

wherein $R^2$ represents an alkyl group having 4 to 20 carbon atoms, n represents 1 or 2, and each $R^2$ may be the same or different; and 0.5% by mass to 5% by mass of a sulfur compound.

2. The lubricant composition for a machining tool according to claim 1, wherein $R^2$ in the general formula (2) represents an alkyl group having 8 carbon atoms.

3. The lubricant composition for a machining tool according to claim 1, wherein $R^1$ in the general formula (1) represents a saturated hydrocarbon group having 1 to 20 carbon atoms.

4. The lubricant composition for a machining tool according to claim 1, which simultaneously lubricates a slideway surface and a hydraulic pump of a machining tool.

5. A lubrication method comprising simultaneously lubricating a slideway surface and a hydraulic pump of a machining tool with the lubricant composition for a machining tool according to claim 1.

* * * * *